US010214964B2

(12) United States Patent
Hornblower et al.

(10) Patent No.: US 10,214,964 B2
(45) Date of Patent: Feb. 26, 2019

(54) CLOSED LOOP CONTROL OF DRILLING TOOLFACE

(71) Applicant: Schlumberger Technology Corporation, Sugar land, TX (US)

(72) Inventors: Peter Hornblower, Gloucester (GB); Christopher C. Bogath, Richmond, TX (US); Adam Bowler, Oxford (GB); Junichi Sugiura, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 560 days.

(21) Appl. No.: 14/766,127

(22) PCT Filed: Mar. 19, 2014

(86) PCT No.: PCT/US2014/031176
§ 371 (c)(1),
(2) Date: Aug. 5, 2015

(87) PCT Pub. No.: WO2014/160567
PCT Pub. Date: Oct. 2, 2014

(65) Prior Publication Data

US 2015/0377004 A1 Dec. 31, 2015

Related U.S. Application Data

(60) Provisional application No. 61/806,522, filed on Mar. 29, 2013.

(51) Int. Cl.
*E21B 45/00* (2006.01)
*E21B 7/06* (2006.01)
(Continued)

(52) U.S. Cl.
CPC ..... *E21B 7/06* (2013.01); *E21B 45/00* (2013.01); *E21B 47/022* (2013.01); *E21B 47/124* (2013.01)

(58) Field of Classification Search
CPC ..... E21B 7/06; E21B 44/005; E21B 47/022
(Continued)

(56) References Cited

U.S. PATENT DOCUMENTS 5,265,682 A 11/1993 Russell et al.
5,321,893 A * 6/1994 Engebretson ..... E21B 47/022 33/304
(Continued)

FOREIGN PATENT DOCUMENTS

CN 202544834 U 11/2012
CN 102996120 3/2013
(Continued)

OTHER PUBLICATIONS

Office Action issued in related RU application 2015146306 dated Jun. 7, 2016, 13 pages.
(Continued)

*Primary Examiner* — Calvin Lee

(57) ABSTRACT

A downhole closed loop method for controlling a drilling toolface includes measuring first and second attitudes of the subterranean borehole at corresponding first and second upper and lower survey stations. The first and second attitudes are processed downhole while drilling to compute an angle change of the subterranean borehole between the upper and lower survey stations. The computed angle change is compared with a predetermined threshold. This process may be continuously repeated while the angle change is less than the threshold. The first and second attitudes are further processed downhole to compute a toolface angle when the angle change of the subterranean
(Continued)

borehole is greater than or equal to the threshold. The toolface angle may then be further processed to control a direction of drilling of the subterranean borehole.

16 Claims, 5 Drawing Sheets

(51) Int. Cl.
*E21B 47/12* (2012.01)
*E21B 47/022* (2012.01)

(58) Field of Classification Search
USPC ..... 257/48; 438/5, 14; 175/26, 45, 61, 73, 175/263; 702/9
See application file for complete search history.

(56) References Cited

U.S. PATENT DOCUMENTS 6,092,610 A 7/2000 Kosmala et al.
6,109,372 A 8/2000 Dorel et al.
6,265,682 B1 7/2001 Russell et al.
6,819,111 B2 11/2004 Fanini et al.
7,182,154 B2 * 2/2007 Harrison ..... E21B 7/04 175/26
7,234,540 B2 * 6/2007 Estes ..... E21B 47/022 175/45
7,243,719 B2 * 7/2007 Baron et al. ..... 175/26
7,584,788 B2 9/2009 Baron et al.
7,669,669 B2 3/2010 Downton et al.
7,725,263 B2 5/2010 Sugiura
8,024,121 B2 * 9/2011 Tang ..... E21B 47/12 702/6
8,082,105 B2 * 12/2011 Ryu ..... E21B 49/006 702/11
9,273,517 B2 * 3/2016 Tchakarov ..... E21B 7/06 702/9
9,273,547 B2 * 3/2016 Brooks ..... E21B 47/022 33/501
9,540,922 B2 * 1/2017 Zhong ..... E21B 47/02216 702/7
9,879,490 B2 * 1/2018 Edbury ..... E21B 21/08 174/27
2004/0050590 A1 3/2004 Pirovolou et al.
2005/0269082 A1 12/2005 Baron et al.
2006/0260843 A1 11/2006 Cobern
2007/0030007 A1 2/2007 Moore
2009/0065262 A1 3/2009 Downton et al.
2009/0120690 A1 5/2009 Phillips
2010/0175922 A1 7/2010 Ignova et al.
2012/0330551 A1 12/2012 Mitchell et al.
2013/0032401 A1 2/2013 Edbury et al.
2013/0048383 A1 2/2013 Panchal et al.
2013/0124095 A1 * 5/2013 Sugiura ..... E21B 47/124 702/9
2013/0126239 A1 5/2013 Panchal et al.
2013/0151157 A1 6/2013 Brooks et al.
2013/0151158 A1 6/2013 Brooks et al.
2016/0003028 A1 * 1/2016 Aklestad ..... E21B 47/022 702/6

FOREIGN PATENT DOCUMENTS

RU 67635 U1 10/2007
WO 2012024127 A2 2/2012

OTHER PUBLICATIONS

International Preliminary Report on Patentability issued in related PCT application PCT/US2014/031176 dated Oct. 8, 2015, 8 pages.
International Search Report and Written Opinion issued in related PCT application PCT/US2014/031176 dated Jul. 11, 2015, 12 pages.
Decision on Grant issued in RU application 2015146306 dated Dec. 27, 2016.
Search Report 61 or 63 EPC issued in European application 1477496.3 dated Nov. 17, 2016. 3 pages.
Examination Report 943 EPC issued in European application 1477496.3 dated Dec. 2, 2016. 6 pages.
First Office Action and Search Report issued in Chinese patent application 201480018721.7 dated Jul. 28, 2017. 18 pages.
Second Office Action and Search Report issued in Chinese patent application 201480018721.7 dated Mar. 19, 2018. 8 pages.
Third Office Action issued in Chinese Patent Application 201480018724.7 dated Sep. 17, 2018, 14 pages.

* cited by examiner

CLOSED LOOP CONTROL OF DRILLING TOOLFACE

FIELD OF THE INVENTION

Disclosed embodiments relate generally to methods for maintaining directional control during downhole directional drilling operations and more particularly to method for determining a downhole toolface offset while drilling.

BACKGROUND INFORMATION

The use of automated drilling methods is becoming increasingly common in drilling subterranean wellbores. Such methods may be employed, for example, to control the direction of drilling based on various downhole feedback measurements, such as inclination and azimuth measurements made while drilling or logging while drilling measurements.

One difficulty with automated drilling methods (and directional drilling methods in general) is that directional drilling tools exhibit tendencies to drill (or turn) in a direction offset from the set point direction. For example, when set to drill a horizontal well straight ahead, certain drilling tools may have a tendency to drop inclination (turn downward) and/or to turn to the left or right. Exacerbating this difficulty, these tendencies can be influenced by numerous factors and may change unexpectedly during a drilling operation. Factors influencing the directional tendency may include, for example, properties of the subterranean formation, the configuration of the bottom hole assembly (BHA), bit wear, bit/stabilizer walk, an unplanned touch point (e.g. due to compression and buckling of the BHA), stabilizer-formation interaction, the steering mechanism utilized by the steering tool, and various drilling parameters.

In current drilling operations, a drilling operator generally corrects the directional tendencies by evaluating wellbore survey data transmitted to the surface. A surface computation of the gravity toolface of the well is generally performed at 30 to 100 foot intervals (e.g., at the static survey stations). While such techniques are serviceable, there is a need for further improvement, particularly for automatically accommodating (or correcting) such tendencies downhole while drilling.

SUMMARY

A downhole closed loop method for controlling a drilling toolface of a subterranean borehole is disclosed. The method includes receiving reference and measured attitudes of the subterranean borehole while drilling with the reference attitude being measured at an upper survey station and the measured attitude being measured at a lower survey station. The reference attitude and the measured attitude are processed downhole while drilling (using a downhole processor) to compute an angle change of the subterranean borehole between the upper and lower survey stations. The computed angle change is compared with a predetermined threshold. This process may be continuously repeated while the angle change is less than the threshold. The reference attitude and the measured attitude are further processed downhole to compute a toolface angle when the angle change of the subterranean borehole is greater than or equal to the threshold. The toolface angle may then be further processed to control a direction of drilling of the subterranean borehole.

The disclosed embodiments may provide various technical advantages. For example, the disclosed embodiments provide for real-time closed loop control of the drilling toolface. As such, the disclosed methods may provide for improved well placement and reduced wellbore tortuosity. Moreover, by providing for closed loop control, the disclosed methods tend to improve drilling efficiency and consistency.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
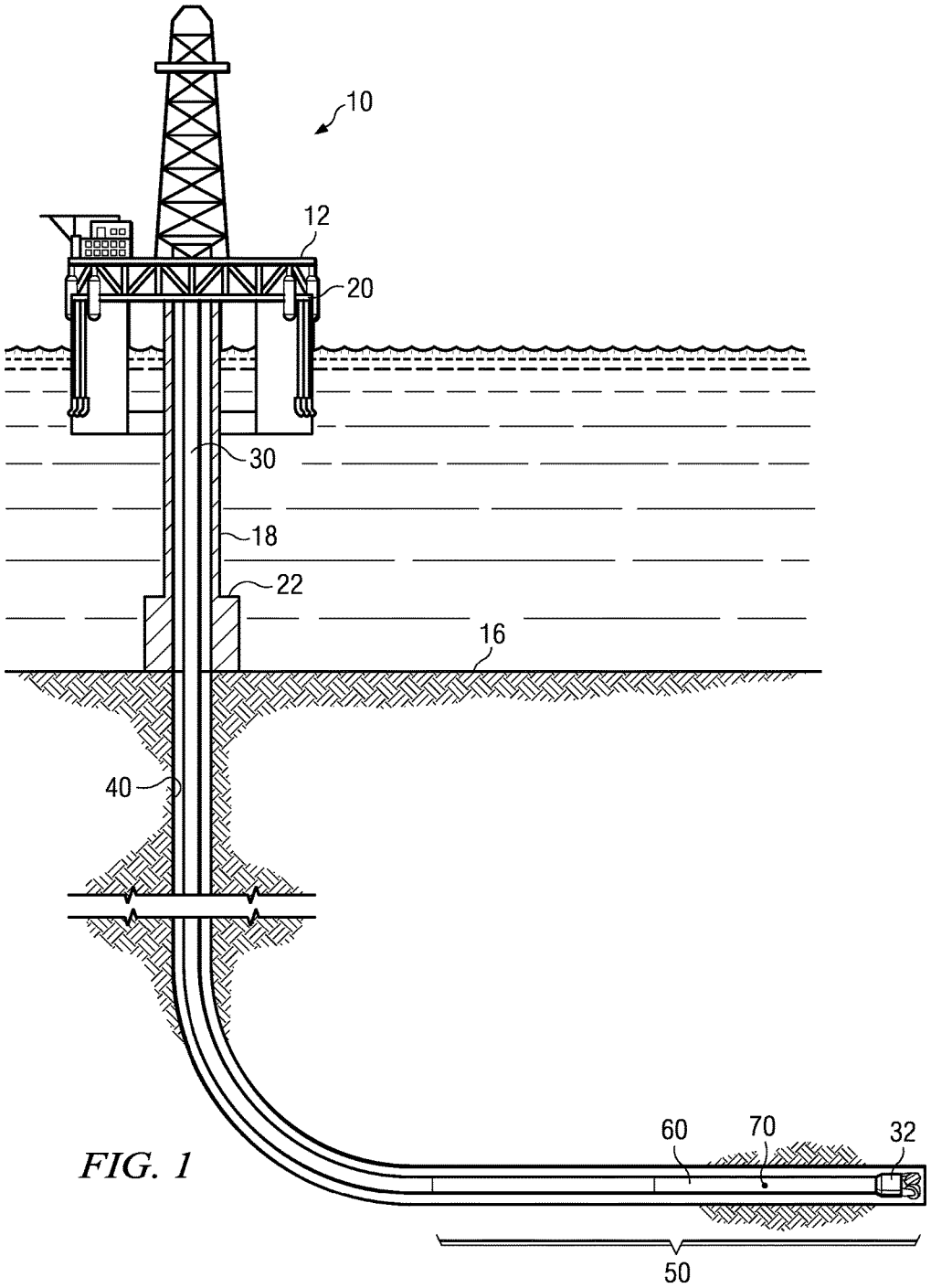
FIG. 1 depicts an example drilling rig on which disclosed embodiments may be utilized.

FIG. 1 depicts a drilling rig 10 suitable for using various method and system embodiments disclosed herein. A semi-submersible drilling platform 12 is positioned over an oil or gas formation (not shown) disposed below the sea floor 16. A subsea conduit 18 extends from deck 20 of platform 12 to a wellhead installation 22. The platform may include a derrick and a hoisting apparatus for raising and lowering a drill string 30, which, as shown, extends into borehole 40 and includes a bottom hole assembly (BHA) 50. The BHA 50 includes a drill bit 32, a steering tool 60 (also referred to as a directional drilling tool), and one or more downhole navigation sensors 70 such as measurement while drilling sensors including three axis accelerometers and/or three axis magnetometers. The BHA 50 may further include substantially any other suitable downhole tools such as a downhole drilling motor, a downhole telemetry system, a reaming tool, and the like. The disclosed embodiments are not limited in regards to such other tools.

It will be understood that the BHA may include substantially any suitable steering tool 60, for example, including a rotary steerable tool. Various rotary steerable tool configurations are known in the art including various steering mechanisms for controlling the direction of drilling. For example, many existing rotary steerable tools include a substantially non-rotating outer housing employing blades that engage the borehole wall. Engagement of the blades with the borehole wall is intended to eccenter the tool body, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the borehole wall.

The PowerDrive® rotary steerable systems (available from Schlumberger) fully rotate with the drill string (i.e., the outer housing rotates with the drill string). The PowerDrive® Xceed™ makes use of an internal steering mechanism that does not require contact with the borehole wall and enables the tool body to fully rotate with the drill string. The PowerDrive® X5, X6, and PowerDrive Orbit® rotary steerable systems make use of mud actuated blades (or pads) that contact the borehole wall. The extension of the blades (or pads) is rapidly and continually adjusted as the system rotates in the borehole. The PowerDrive Archer® makes use of a lower steering section joined at an articulated swivel with an upper section. The swivel is actively tilted via pistons so as to change the angle of the lower section with respect to the upper section and maintain a desired drilling direction as the bottom hole assembly rotates in the borehole. Accelerometer and magnetometer sets may rotate with the drill string or may alternatively be deployed in an internal roll-stabilized housing such that they remain substantially stationary (in a bias phase) or rotate slowly with respect to the borehole (in a neutral phase). To drill a desired curvature, the bias phase and neutral phase are alternated during drilling at a predetermined ratio (referred to as the steering ratio). Again, the disclosed embodiments are not limited to use with any particular steering tool configuration.

The downhole sensors 70 may include substantially any suitable sensor arrangement used making downhole navigation measurements (borehole inclination, borehole azimuth, and/or tool face measurements). Such sensors may include, for example, accelerometers, magnetometers, gyroscopes, and the like. Such sensor arrangements are well known in the art and are therefore not described in further detail. The disclosed embodiments are not limited to the use of any particular sensor embodiments or configurations. Methods for making real-time while drilling measurements of the borehole inclination and borehole azimuth are disclosed, for example, in commonly assigned U.S. Patent Publications 2013/0151157 and 2013/0151158. In the depicted embodiment, the sensors 70 are shown to be deployed in the steering tool 60. Such a depiction is merely for convenience as the sensors 70 may be deployed elsewhere in the BHA.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
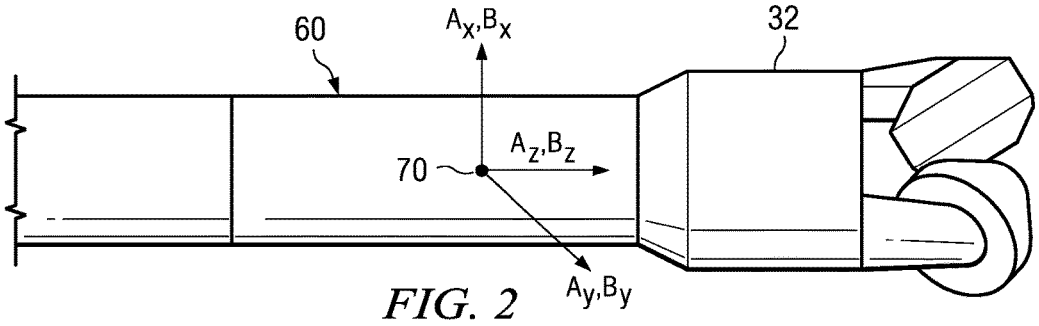
FIG. 2 depicts a lower BHA portion of the drill string shown on FIG. 1.

FIG. 2 depicts the lower BHA portion of drill string 30 including drill bit 32 and steering tool 60. As described above with respect to FIG. 1, the steering tool may include navigation sensors 70 including tri-axial (three axis) accelerometer and magnetometer navigation sensors. Suitable accelerometers and magnetometers may be chosen from among substantially any suitable commercially available devices known in the art. FIG. 2 further includes a diagrammatic representation of the tri-axial accelerometer and magnetometer sensor sets. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_z$) are oriented substantially parallel with the borehole as indicated (although disclosed embodiments are not limited by such conventions). Each of the accelerometer and magnetometer sets may therefore be considered as determining a plane (the x and y-axes) and a pole (the z-axis along the axis of the BHA).

Figure 3:
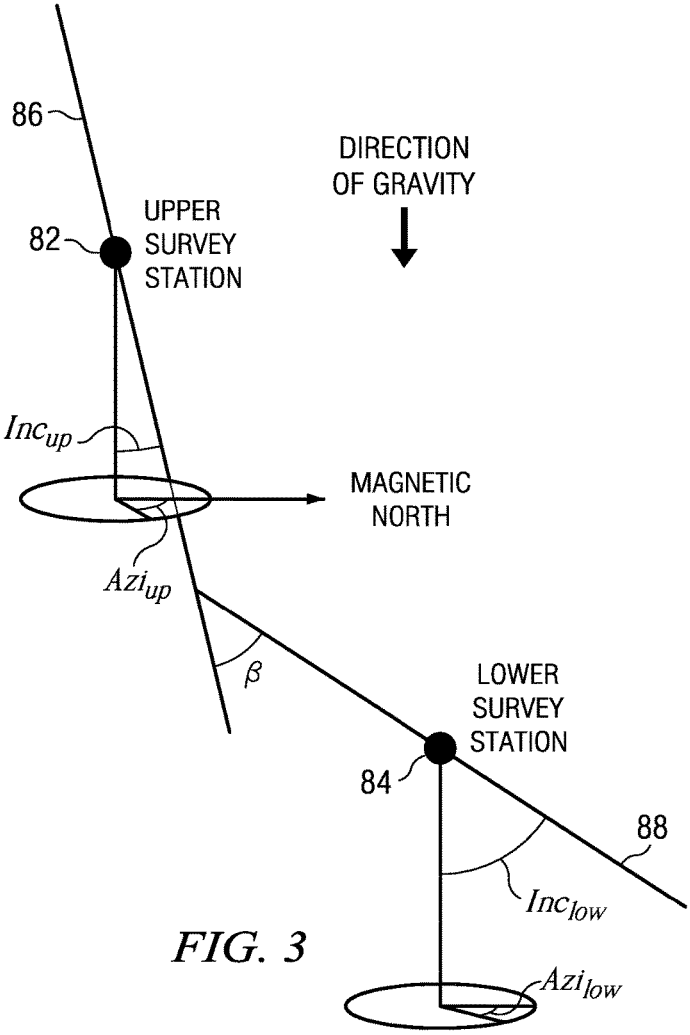
FIG. 3 depicts a diagram of attitude and steering parameters in a global coordinate reference frame.

FIG. 3 depicts a diagram of attitude in a global coordinate reference frame at first and second upper and lower survey stations 82 and 84. The attitude of a BHA defines the orientation of the BHA axis (axis 86 at the upper survey station 82 and axis 88 at the lower survey station 84) in three-dimensional space. In wellbore surveying applications, the wellbore attitude represents the direction of the BHA axis in the global coordinate reference frame (and is commonly understood to be approximately equal to the direction of propagation of the drill bit). Attitude may be represented by a unit vector the direction of which is often defined by the borehole inclination and the borehole azimuth. In FIG. 2 the borehole inclination at the upper and lower survey stations 82 and 84 is represented by $Inc_{up}$ and $Inc_{low}$ while the borehole azimuth is represented by $Azi_{up}$ and $Azi_{low}$. The angle β represents the overall angle change of the borehole between the first and second survey stations 82 and 84.

Figure 4:
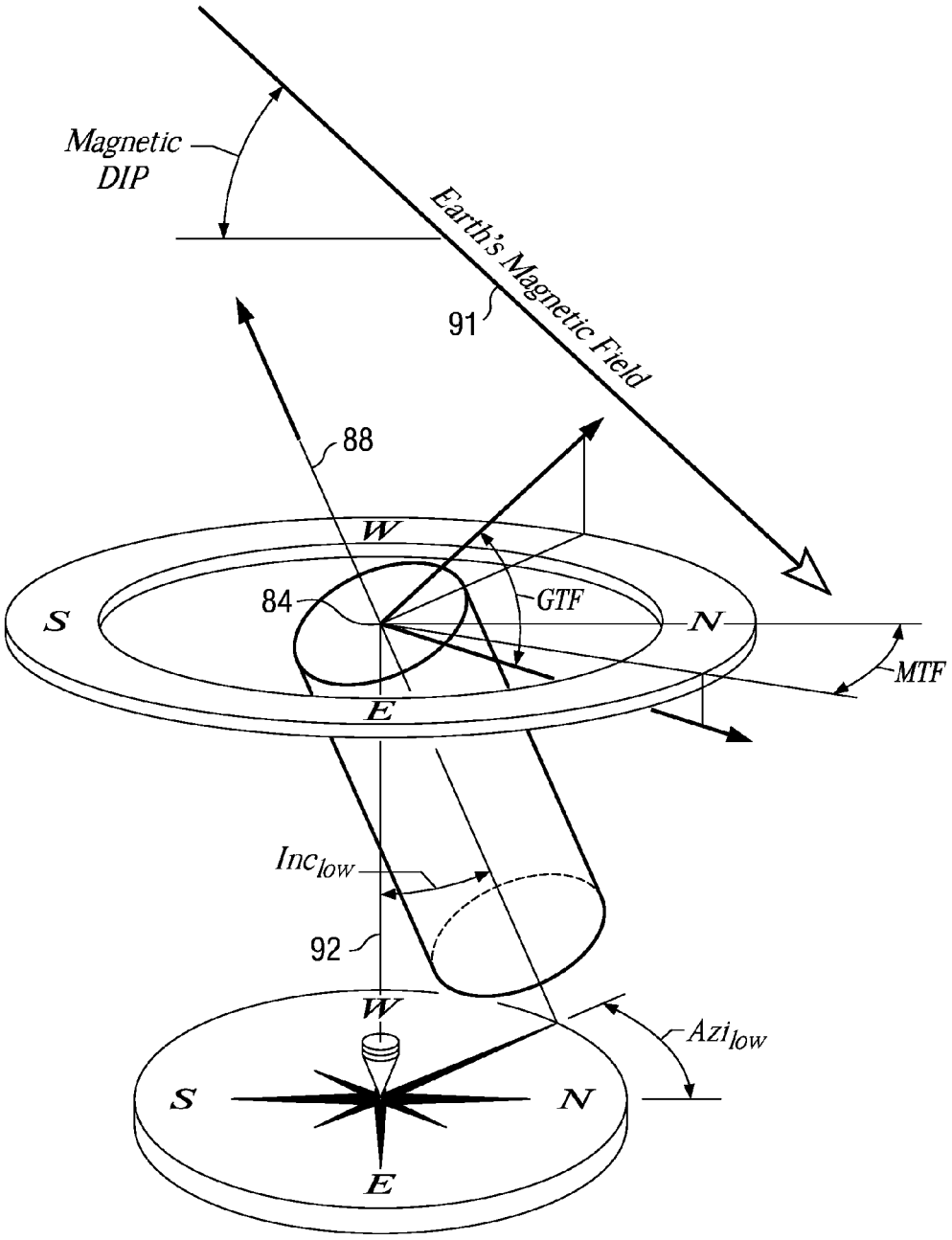
FIG. 4 depicts a diagram of gravity toolface and magnetic toolface in a global reference frame.

FIG. 4 depicts a further diagram of attitude and toolface in a global coordinate reference frame at the second lower survey station 84. The Earth's magnetic field and gravitational field are depicted at 91 and 92. The borehole inclination $Inc_{low}$ represents the deviation of axis 88 from vertical while the borehole azimuth $Azi_{low}$ represents the deviation of a projection of the axis 88 on the horizontal plane from magnetic north. Gravity toolface (GTF) is the angular deviation about the circumference of the downhole tool of some tool component with respect to the highside (HS) of the tool collar (or borehole). In this disclosure gravity tool face (GTF) represents the angular deviation between the direction towards which the drill bit is being turned and the highside direction (e.g., in a slide drilling operation, the gravity tool face represents the angular deviation between a bent sub scribe line and the highside direction). Magnetic toolface (MTF) is similar to GTF but uses magnetic north as a reference direction. In particular, MTF is the angular deviation in the horizontal plane between the direction towards which the drill bit is being turned and magnetic north.

It will be understood that the disclosed embodiments are not limited to the above described conventions for defining borehole coordinates depicted in FIGS. 2, 3, and 4. It will be further understood that these conventions can affect the form of certain of the mathematical equations that follow in this disclosure. Those of ordinary skill in the art will be readily able to utilize other conventions and derive equivalent mathematical equations.

Figure 5:
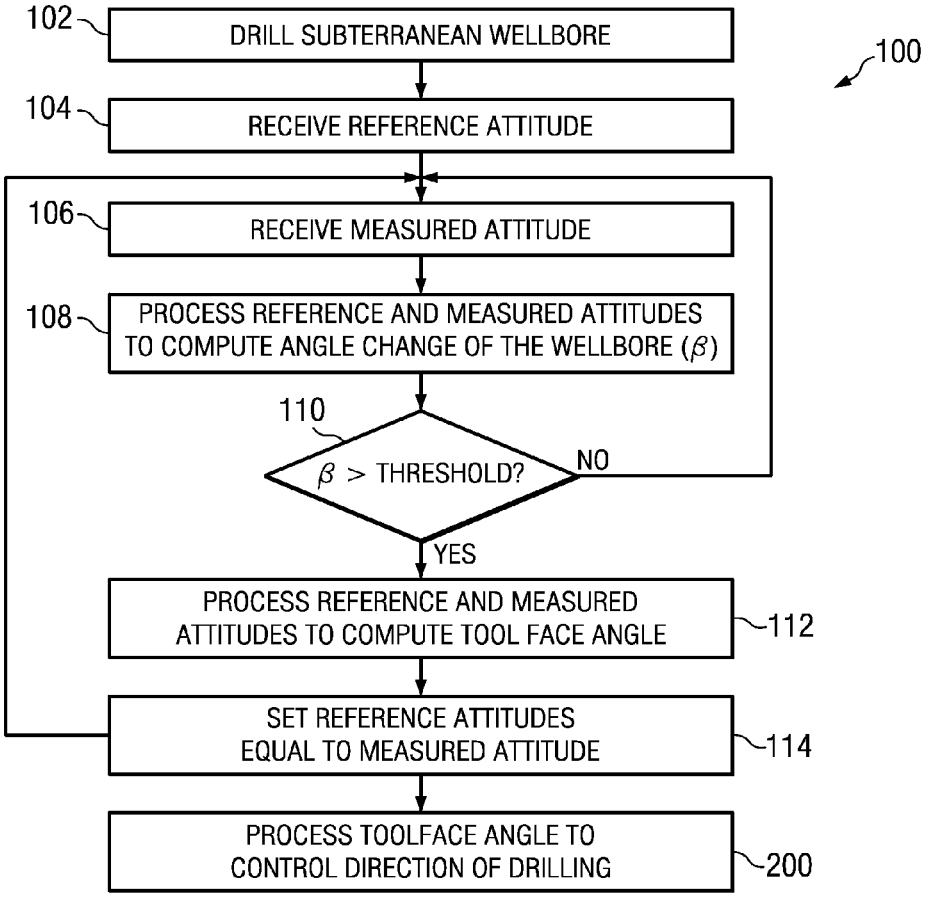
FIG. 5 depicts a flow chart of one disclosed closed loop method embodiment for obtaining the drilling toolface.

FIG. 5 depicts a flow chart of one disclosed closed loop method embodiment 100 for obtaining the drilling toolface. A subterranean borehole is drilled at 102, for example, via rotating a drill string, pumping drilling fluid through a downhole mud motor, or the like. A directional drilling tool (steering tool) may also be actuated so as to control the direction of drilling (the drilling attitude) and thereby steer the drill bit. A reference attitude is received at 104. The reference attitude may include, for example, a previously measured attitude. A measured attitude is received 106. The reference and measured attitudes may include inclination and azimuth values measured using substantially any suitable downhole sensor arrangements, for example, including the aforementioned accelerometers, magnetometers, and gyroscopic sensors. The reference attitude may include a previously measured attitude obtained from an upper survey station while the measured attitude may include a currently measured attitude obtained from a lower survey station.

At 108 the reference and measured attitudes are processed to compute an overall angle change β of the borehole between first and second survey stations (see FIG. 3). The angle β is then compared with a predetermined threshold value at 110. When β is less than the threshold, the method returns to 106 and receives a subsequent measured attitude (an attitude measured later in time as compared to the previously measured attitude) and then re-computes β at 108. When β is greater than or equal to the threshold value at 110, the reference and measured attitudes are further processed at 112 to compute the toolface angle (e.g., the GTF and/or the MTF) of the drill bit (i.e., the tool face angle towards which the drill bit is turning). The computed toolface angle is then further processed at 200 as described in more detail below with respect to FIGS. 6 and 7 to control the direction of drilling. At 114 the reference attitude (originally received at 104) is reset such that it equals the most recently measured attitude received at 106. The method then cycles back to 106 and receives another measured attitude and then re-computes β at 108.

The attitude received at 106 may be measured, for example, using static and/or continuous inclination and azimuth measurement techniques. Static measurements may be obtained, for example, when drilling is temporarily suspended to add a new pipe stand to the drill string. Continuous measurements may be obtained, for example, from corresponding continuous measurements of the axial component of the gravitational and magnetic fields ($A_z$ and $B_z$ in FIG. 2) using techniques known to those of ordinary skill in the art (e.g., as disclosed in U.S. Patent Publication 2013/0151157 which is fully incorporated by reference herein). The continuous inclination and azimuth measurements may further be filtered to reduce the effects of noise. For example, a suitable digital filter may include a first-order infinite impulse response (IIR) filter. Such filtering techniques are also known to those of ordinary skill in the art and need not be discussed further herein.

The reference and measured attitudes may be processed at 108 to compute the angle β between the upper and lower survey stations, for example, as follows:

$$\beta=\arccos\{\cos(Inc_{low}-Inc_{up})-\sin(Inc_{low})\sin(Inc_{up})[1-\cos(Azi_{low}-Azi_{up})]\} \quad (1)$$

where $Inc_{low}$ and $Azi_{low}$ represent the measured attitude (inclination and azimuth) and $Inc_{up}$ and $Azi_{up}$ represent the reference attitude (inclination and azimuth). Given that the overall angle change of the well is often small in a continuous drilling operation, one or more of the following approximations may be used when β is small (e.g., less than about 5 degrees):

$$\beta=\sqrt{(Inc_{low}-Inc_{up})^2+\sin(Inc_{low})\sin(Inc_{up})(Azi_{low}-Azi_{up})^2} \quad (2)$$

$$\beta=\sqrt{(Inc_{low}-Inc_{up})^2+\sin^2(Inc_{low})(Azi_{low}-Azi_{up})^2} \quad (3)$$

$$\beta=\sqrt{(Inc_{low}-Inc_{up})^2+\sin^2(Inc_{up})(Azi_{low}-Azi_{up})^2} \quad (4)$$

When making continuous (while drilling) attitude measurements, the continuous azimuth measurements are commonly noisier than the continuous inclination measurements. As such, Equations 2-4 may be modified to include a weighting factor AW to desensitize the effect of the noisier azimuth on the overall angle change β.

$$\beta_{weighted}=\sqrt{(Inc_{low}-Inc_{up})^2+AW\sin(Inc_{low})\sin(Inc_{up})(Azi_{low}-Azi_{up})^2} \quad (5)$$

$$\beta_{weighted}=\sqrt{(Inc_{low}-Inc_{up})^2+AW\sin^2(Inc_{low})(Azi_{low}-Azi_{up})^2} \quad (6)$$

$$\beta_{weighted}=\sqrt{(Inc_{low}-Inc_{up})^2+AW\sin^2(Inc_{up})(Azi_{low}-Azi_{up})^2} \quad (7)$$

wherein the weighting factor AW is in a range from 0 to 1 and may be selected based on the noise levels in the inclination and azimuth values. In certain embodiments, the weighting factor AW may be in a range from about 0.1 to about 0.5 (although the disclosed embodiments are by no means limited in this regard). Equations 2-7 may be advantageously utilized on a downhole computer/processor as they reduce the number of trig functions (which tend to use substantial computational resources).

Substantially any suitable threshold may be used at 110, for example, in a range from about 0.25 to about 2.5 degrees. In general increasing the value of the threshold reduces the error in the toolface value computed at 112. In one embodiment, a toolface error in a range from about 5-10 degrees may be achieved using a threshold value of 0.5 degrees. Using a threshold value of 1.0 degree may advantageously further reduce the toolface error. It will be understood that the threshold is related to the curvature of the wellbore section being drilled and the distance drilled. For example, at a curvature of 5 degrees per 100 feet of wellbore, a threshold of 0.5 degrees corresponds to a distance drilled of 10 feet. As such the control loop depicted in FIG. 5 may be thought of as being a substantially depth-domain controller.

It will be further understood that the measured value of β may be processed downhole to obtain an approximate rate of penetration ROP of drilling, for example, as follows:

$$ROP=\frac{\beta}{\Delta t\cdot DLS} \quad (8)$$

where DLS represents the dogleg severity (curvature) of the borehole section being drilled and Δt represents the time passed between making measurements at the first and second upper and lower survey stations. This estimated ROP may be advantageously used, for example, to project the continuous survey sensor measurements to the bit (or other locations in the string). It will be understood that "static" and/or substantially continuous ROP values may be computed. For example, a static ROP may be computed at 112 when β exceeds the threshold. A substantially continuous ROP may be computed, for example, at 108 when computing β thereby giving a near instantaneous rate of penetration. Such a near instantaneous rate of penetration may optionally be filtered, for example, using a rolling average window or other filtering technique.

The reference and measured attitudes may be further processed at 112 to compute the GTF or MTF angles, for example, as follows:

$$GTF = \arctan\left[\frac{\sin(Inc_{low})\sin(Azi_{low} - Azi_{up})}{\cos(Inc_{up})\sin(Inc_{low})\cos(Azi_{low} - Azi_{up}) - \sin(Inc_{up})\cos(Inc_{low})}\right] \tag{9}$$

$$MTF = \arctan\left[\frac{\begin{array}{c}\cos^2(Inc_{up})\sin(Inc_{low})\sin(Azi_{low}) - \sin(Inc_{up})\cos(Inc_{up})\sin(Azi_{up})\cos(Inc_{low}) + \\ \sin^2(Inc_{up})\sin(Inc_{low})\cos(Azi_{up})\sin(Azi_{low} - Azi_{up})\end{array}}{\begin{array}{c}\cos^2(Inc_{up})\sin(Inc_{low})\cos(Azi_{low}) - \sin(Inc_{up})\cos(Inc_{up})\cos(Azi_{up})\cos(Inc_{low}) - \\ \sin^2(Inc_{up})\sin(Inc_{low})\sin(Azi_{up})\sin(Azi_{low} - Azi_{up})\end{array}}\right] \tag{10}$$

An approximate GTF may be computed based on the assumption that β is small (e.g., less than about 5 degrees), for example, as follows:

$$GTF = \arctan\left(\frac{(Azi_{low} - Azi_{up})\sin(Inc_{up})}{Inc_{low} - Inc_{up}}\right) \tag{11}$$

Likewise, an approximate MTF may be computed when the borehole inclination is small (e.g., less than about 5 degrees) at the upper and lower survey stations, for example, as follows:

$$MTF = \arctan\left(\frac{\sin(Inc_{low})\sin(Azi_{low}) - \sin(Inc_{up})\sin(Azi_{up})}{\sin(Inc_{low})\cos(Azi_{low}) - \sin(Inc_{up})\cos(Azi_{up})}\right) \tag{12}$$

Equations 11 and 12 require less intensive computation and may therefore be advantageous when implementing the disclosed method on a downhole controller. It will be understood that the MTF and/or the GTF may alternatively (and/or additionally) be computed using other known mathematical relations, for example, utilizing inclination and magnetic dip angle or inclination, azimuth, and magnetic dip angle. Such mathematical relations are disclosed, for example, in U.S. Pat. No. 7,243,719 and U.S. Patent Publication 2013/0126239, each of which is incorporated by reference in its entirety herein.

The computed toolface values may be compared with a toolface set point value to compute toolface offset values (the error or offset between the set point value and the actual measured value) in substantially real time while drilling. The toolface offset values may be further processed to obtain a transfer function of the directional drilling system. This transfer function may be further evaluated in combination with various drilling and BHA parameters (e.g., formation type, rate of penetration, BHA configuration, etc) to evaluate the performance of the drilling system.

Figure 6:
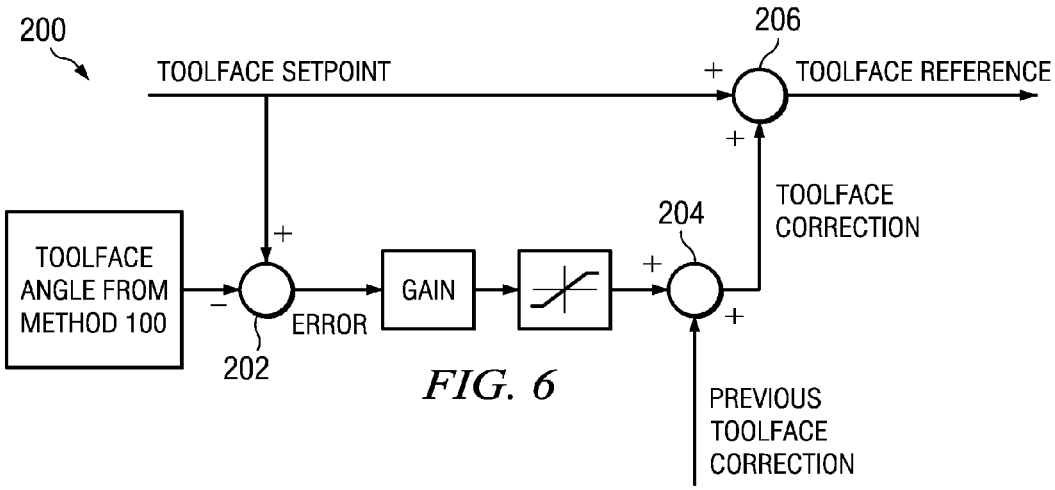
FIG. 6 depicts one embodiment of a controller by which the toolface angle obtained in the method depicted on FIG. 5 may be processed to control the direction of drilling.

FIG. 6 depicts one embodiment of a controller 200 by which the toolface angle may be processed to control the direction of drilling. The toolface angle obtained from method 100 may be combined at 202 with the toolface set point value (e.g., the desired toolface angle set by the drilling operator) to obtain a toolface error. The toolface error may be in turn be combined at 204 with a previous toolface correction to obtain a current toolface correction which may be further combined at 206 with the toolface set point value to obtain a toolface reference. It will be understood that the control structure depicted on FIG. 6 functions like a proportional integral (P+I) controller (with a P gain of 1) for changes in the toolface set point value and like an integral only controller when responding to toolface disturbances. The disclosed embodiments are of course not limited to any particular type of controller. For example, other controllers such as a proportional controller, a proportional differential controller, or a proportional integral differential controller may be used. Non classic controllers, such as a model predictive controller, a fuzzy controller, and the like may also be used.

Figure 7:
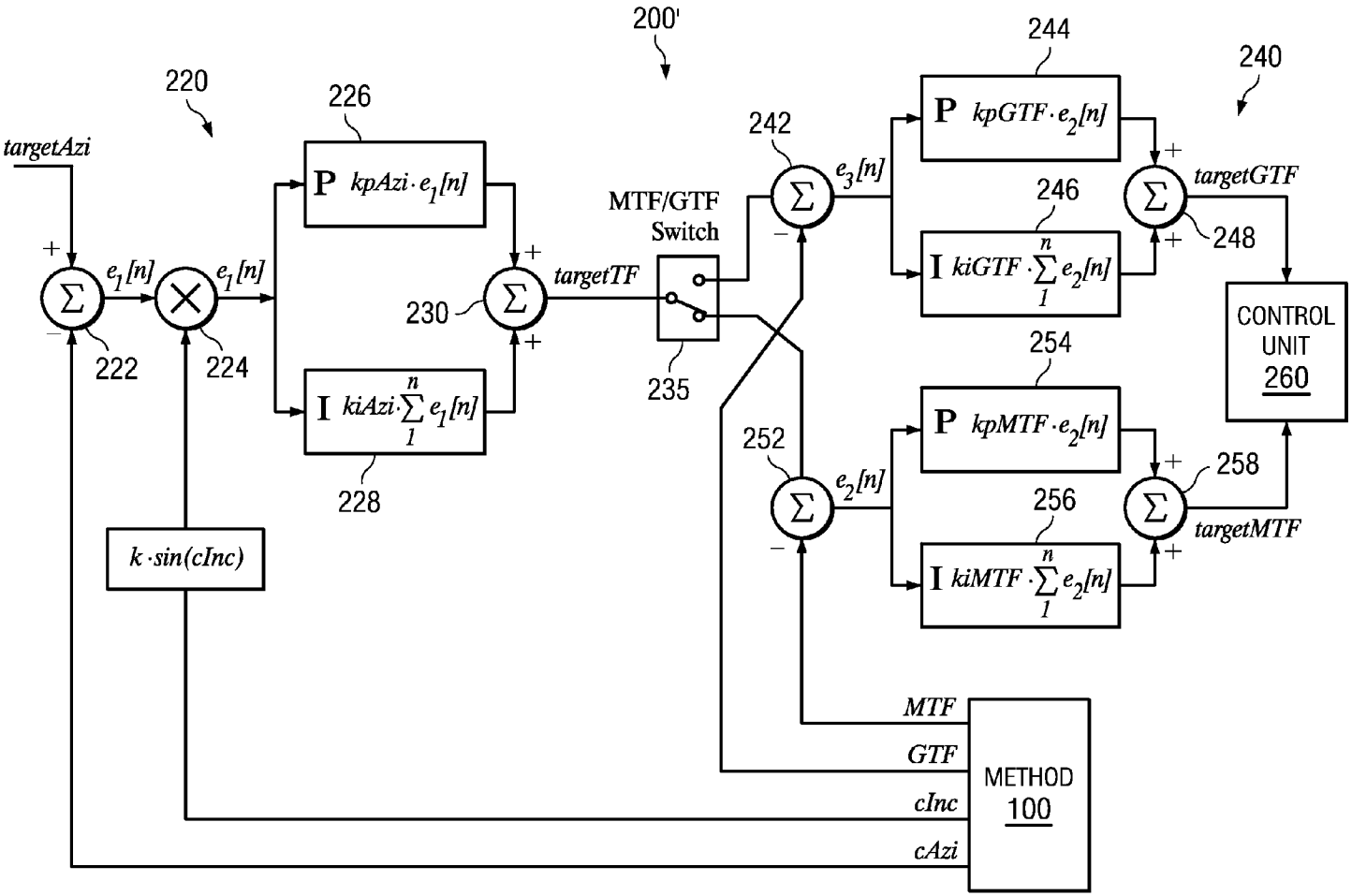
FIG. 7 depicts a cascade controller that may process the toolface angle obtained in the method depicted on FIG. 5 to drive the drilling tool to a target azimuth.

FIG. 7 depicts a cascade controller 200' that may process the toolface angle obtained from method 100 to drive the drilling tool to a target azimuth. The depicted controller includes a P+I outer closed loop 220 to drive the drill cycle survey azimuth to a target azimuth downlinked by a drilling operator and a P+I inner closed loop 240 to drive the measured toolface (MTF or GTF) to the target toolface. At the start of the implantation (e.g., at the beginning of an automated drilling operation) it may be desirable to disable (switch off) the outer loop 220 to enable the tuning of the inner loop 240 via setting gains kpAzi and kpAzi equal to zero.

In the outer loop 220, the target azimuth tar getAzi is combined at 222 with the measured azimuth cAzi from method 100 to obtain an azimuth error signal: $e_1[n]$=targetAzi−cAzi. The azimuth error signal is further combined at 224 with a weighted value of the measured inclination k sin(cInc) to obtain a weighted azimuthal error signal: $e'_1[n]=e_1[n]\cdot k\cdot\sin(cInc)$. Proportional and integral gains of the weighted azimuthal error signal are computed at 226 and 228 and combined at 230 to obtain a target toolface of the well: $targetTF=kpAzi\cdot e'_1[n]+kiAzi\cdot\Sigma_1^n e'_1[n]$. The target toolface may be either a GTF or a MTF and may be automatically (or manually) selected at 235, for example, based on the inclination of the wellbore.

In the inner loop 240 a target GTF or a target MTF are computed and input into control unit 260 that controls the direction of drilling. When the MTF/GTF switch 235 is set to select GTF, the target toolface of the well targetTF is combined at 242 with a GTF obtained from method 100 to obtain a GTF error signal: $e_3[n]$=targetTF−GTF. Proportional and integral gains of the GTF error signal are computed at 244 and 246 and combined at 248 to obtain the target GTF of the control unit: $targetGTF=kpGTF\cdot e_3[n]+kiGTF\cdot\Sigma_1^n e_3[n]$. When the MTF/GTF switch 235 is set to select MTF, the target toolface of the well targetTF is combined at 252 with an MTF obtained from method 100 to obtain an MTF error signal: $e_2[n]$=targetTF−MTF. Proportional and integral gains of the MTF error signal are computed at 254 and 256 and combined at 258 to obtain the target MTF of the control unit: $targetMTF=kpMTF\cdot e_2[n]+kiMTF\cdot\Sigma_1^n e_2[n]$.

The methods described herein are configured for downhole implementation via one or more controllers deployed downhole (e.g., in a steering/directional drilling tool). A suitable controller may include, for example, a programmable processor, such as a microprocessor or a microcontroller and processor-readable or computer-readable program code embodying logic. A suitable processor may be utilized, for example, to execute the method embodiments described above with respect to FIGS. 5, 6, and 7 as well as the corresponding disclosed mathematical equations. A suitable controller may also optionally include other controllable components, such as sensors (e.g., a depth sensor), data storage devices, power supplies, timers, and the like. The controller may also be disposed to be in electronic communication with the attitude sensors (e.g., to receive the continuous inclination and azimuth measurements). A suitable controller may also optionally communicate with other instruments in the drill string, such as, for example, telemetry systems that communicate with the surface. A suitable controller may further optionally include volatile or non-volatile memory or a data storage device.

With continued reference to FIG. 7, disclosed embodiments may further include a downhole steering tool having a downhole steering tool body, a steering mechanism for controlling a direction of drilling a subterranean borehole and sensors for measuring an attitude of the subterranean borehole. The steering tool may further include a downhole controller including (i) a toolface module having instructions (as in method 100 on FIG. 5) to process attitude measurements received from the sensors to obtain a drilling toolface, (ii) an outer control loop having instructions to process the attitude measurements received from the sensors and a target azimuth to obtain a target toolface, (iii) an inner loop having instructions to process the drilling toolface and the target toolface to obtain an error signal, and (iv) a control unit target including instructions to process the error signal to obtain instructions for the steering mechanism for controlling the direction of drilling.

Although closed loop control of drilling toolface and certain advantages thereof have been described in detail, it should be understood that various changes, substitutions and alterations may be made herein without departing from the spirit and scope of the disclosure as defined by the appended claims.

What is claimed is:

1. A downhole closed loop method for controlling a drilling toolface when drilling a subterranean borehole, the method comprising:

(a) drilling the subterranean borehole;

(b) measuring a first attitude of the subterranean borehole at a first upper survey station;

(c) measuring a second attitude of the subterranean borehole at a second lower survey station;

(d) processing downhole the first attitude and the second attitude to compute an angle change of the subterranean borehole between the upper and lower survey stations;

(e) repeating (b), (c), and (d) until the angle change of the subterranean borehole is greater than or equal to a predetermined threshold;

(f) processing downhole the reference attitude and the measured attitude to compute a toolface angle;

(g) processing downhole the toolface angle computed in (f) to control a direction of drilling of the subterranean borehole, processing downhole the toolface angle further comprising:

1) processing the target toolface and the toolface angle computed in (f) to obtain an error signal, 2) and processing the error signal to obtain a target toolface for a control unit; and (h) applying the target toolface for the control unit to change the direction of drilling.

2. A downhole closed loop method for controlling a drilling toolface when drilling a subterranean borehole, the method comprising:

(a) drilling the subterranean borehole;

(b) receiving a reference attitude of the subterranean borehole, the reference attitude measured at an upper survey station;

(c) receiving a measured attitude of the subterranean borehole; the measured attitude measured at a lower survey station;

(d) processing downhole the reference attitude and the measured attitude to compute an angle change of the subterranean borehole between the upper and lower survey stations;

(e) comparing the angle change of the subterranean borehole with a predetermined threshold;

(f) repeating (c), (d), and (e) when the angle change of the subterranean borehole is less than the predetermined threshold;

(g) processing downhole the reference attitude and the measured attitude to compute a toolface angle when the angle change of the subterranean borehole is greater than or equal to the predetermined threshold;

(h) processing downhole the toolface angle computed in (g) to control a direction of drilling of the subterranean borehole, processing downhole the toolface angle further comprising:

1) processing the target toolface and the toolface angle computed in (g) to obtain an error signal, and 2) processing the error signal to obtain a target toolface for a control unit; and (i) applying the target toolface for the control unit to change the direction of drilling.

3. The method of claim 2, wherein (h) further comprises:

(i) processing a target azimuth and the measured attitude received in (c) to compute a target toolface;

(ii) processing the target toolface and the toolface angle computed in (g) to obtain an error signal;

(iii) processing the proportional and integral gains of the error signal to obtain a target toolface for a control unit; and (iv) applying the target toolface for a control unit to change the direction of drilling.

4. The method of claim 2, wherein the angle change of the subterranean borehole is computed in (d) using one of the following mathematical equations:

$$\beta = \sqrt{(Inc_{low} - Inc_{up})^2 + \sin^2(Inc_{up})(Azi_{low} - Azi_{up})^2}\ ;$$

$$\beta = \sqrt{(Inc_{low} - Inc_{up})^2 + \sin^2(Inc_{low})(Azi_{low} - Azi_{up})^2}\ ;$$

$$\beta = \sqrt{(Inc_{low} - Inc_{up})^2 + \sin(Inc_{low})\sin(Inc_{up})(Azi_{low} - Azi_{up})^2}\ ;$$

wherein β represents the angle change of the subterranean borehole, $Inc_{low}$ and $Azi_{low}$ represent the measured attitude at the lower survey station, and $Inc_{up}$ and $Azi_{up}$ represent the reference attitude at the upper survey station.

5. The method of claim 2, wherein (h) further comprises:

(i) processing the toolface angle computed in (g) and a set point toolface to obtain a toolface error;

(ii) processing the toolface error to obtain a toolface correction; and (iii) applying the toolface correction to change the direction of drilling.

6. The method of claim 2, wherein the toolface angle is computed in (g) using one of the following equations:

$$GTF = \arctan\left[\frac{\sin(Inc_{low})\sin(Azi_{low} - Azi_{up})}{\cos(Inc_{up})\sin(Inc_{low})\cos(Azi_{low} - Azi_{up}) - \sin(Inc_{up})\cos(Inc_{low})}\right]$$

$$MTF = \arctan\left[\frac{\begin{array}{c}\cos^2(Inc_{up})\sin(Inc_{low})\sin(Azi_{low}) - \sin(Inc_{up})\cos(Inc_{up})\sin(Azi_{up})\cos(Inc_{low}) + \\ \sin^2(Inc_{up})\sin(Inc_{low})\cos(Azi_{up})\sin(Azi_{low} - Azi_{up})\end{array}}{\begin{array}{c}\cos^2(Inc_{up})\sin(Inc_{low})\cos(Azi_{low}) - \sin(Inc_{up})\cos(Inc_{up})\cos(Azi_{up})\cos(Inc_{low}) - \\ \sin^2(Inc_{up})\sin(Inc_{low})\sin(Azi_{up})\sin(Azi_{low} - Azi_{up})\end{array}}\right]$$

wherein GTF represents gravity toolface, MTF represents magnetic toolface, $Inc_{low}$ and $Azi_{low}$ represent the measured attitude at the lower survey station, and $Inc_{up}$ and $Azi_{up}$ represent the reference attitude at the upper survey station.

7. The method of claim 2, wherein (h) further comprises:

(i) processing the measured attitude received in (c) in an outer control loop to obtain a target toolface; and (ii) processing the target toolface and the toolface angle computed in (g) in an inner control loop to control the direction of drilling of the subterranean borehole.

8. The method of claim 2, wherein an inclination of the subterranean borehole is less than about 5 degrees and the toolface angle is computed in (g) using the following equation:

$$MTF = \arctan\left(\frac{\sin(Inc_{low})\sin(Azi_{low}) - \sin(Inc_{up})\sin(Azi_{up})}{\sin(Inc_{low})\cos(Azi_{low}) - \sin(Inc_{up})\cos(Azi_{up})}\right)$$

wherein MTF represents magnetic toolface, $Inc_{low}$ and $Azi_{low}$ represent the measured attitude at the lower survey station, and $Inc_{up}$ and $Azi_{up}$ represent the reference attitude at the upper survey station.

9. The method of claim 2, wherein the angle change of the subterranean borehole is less than about 5 degrees and the toolface angle is computed in (g) using the following equation:

$$GTF = \arctan\left(\frac{(Azi_{low} - Azi_{up})\sin(Inc_{up})}{Inc_{low} - Inc_{up}}\right)$$

wherein GTF represents gravity toolface, $Inc_{low}$ and $Azi_{low}$ represent the measured attitude at the lower survey station, and $Inc_{up}$ and $Azi_{up}$ represent the reference attitude at the upper survey station.

10. The method of claim 2, further comprising:

(i) setting the reference attitude equal to the measured attitude when the angle change of the subterranean borehole is greater than or equal to the predetermined threshold; and (j) repeating (c), (d), (e), (f), (g), (h), (h)(1), (h)(2), and (i).

11. The method of claim 2, wherein the predetermined threshold is in a range from about 0.25 to about 2.5 degrees.

12. The method of claim 2, wherein the angle change of the subterranean borehole is computed in (d) using one of the following mathematical equations:

$$\beta = \sqrt{(Inc_{low} - Inc_{up})^2 + AW\sin^2(Inc_{up})(Azi_{low} - Azi_{up})^2}\ ;$$

$$\beta = \sqrt{(Inc_{low} - Inc_{up})^2 + AW\sin^2(Inc_{low})(Azi_{low} - Azi_{up})^2}\ ;$$

$$\beta = \sqrt{(Inc_{low} - Inc_{up})^2 + AW\sin(Inc_{low})\sin(Inc_{up})(Azi_{low} - Azi_{up})^2}\ ;$$

wherein β represents the angle change of the subterranean borehole, $Inc_{low}$ and $Azi_{low}$ represent the measured attitude at the lower survey station, and $Inc_{up}$ and $Azi_{up}$ represent the reference attitude at the upper survey station, and AW represents a weighting factor in a range from 0 to 1.

13. The method of claim 12, wherein AW is in a range from about 0.1 to about 0.5.

14. The method of claim 2, further comprising:

(i) processing the angle change of the subterranean borehole to compute a rate of penetration of the drilling in (a).

15. The method of claim 14, wherein the rate of penetration of drilling in (a) is computed using the following mathematical equation:

$$ROP = \frac{\beta}{\Delta t \cdot DLS}$$

wherein ROP represents the rate of penetration of drilling, DLS represents a dogleg severity of the subterranean borehole being drilled in (a), and Δt represents a time passed between measuring the reference attitude and the measured attitude at the upper and lower survey stations.

16. The method of claim 14, wherein the rate of penetration of drilling is computed in (d) substantially continuously while drilling in (a).

* * * * *